US006726135B2

(12) United States Patent
Pallmann

(10) Patent No.: US 6,726,135 B2
(45) Date of Patent: Apr. 27, 2004

(54) DEVICE FOR COMMINUTING FEED MATERIAL

(75) Inventor: Wilhelm Pallmann, Zweibrücken (DE)

(73) Assignee: Pallmann Maschinenfabrik GmbH & Co. KG, Zweibrücken (DE)

( * ) Notice: Subject to any disclaimer, the term of this patent is extended or adjusted under 35 U.S.C. 154(b) by 254 days.

(21) Appl. No.: 09/938,848

(22) Filed: Aug. 24, 2001

(65) Prior Publication Data

US 2002/0047059 A1 Apr. 25, 2002

(30) Foreign Application Priority Data

Aug. 29, 2000 (DE) ..... 100 42 265

(51) Int. Cl.[7] ..... B02C 25/00

(52) U.S. Cl. ..... 241/32; 241/37; 241/91; 241/299

(58) Field of Search ..... 241/91, 299, 33, 241/289, 290, 37, 32

(56) References Cited

U.S. PATENT DOCUMENTS 1,840,803 A * 1/1932 Babare ..... 241/91

FOREIGN PATENT DOCUMENTS

DE 3505077 1/1987

* cited by examiner

*Primary Examiner*—Mark Rosenbaum
(74) *Attorney, Agent, or Firm*—Friedrich Kueffner

(57) ABSTRACT

A device for comminuting feed material has a rotary blade ring rotating about an axis of rotation. A comminution chamber is enclosed by the rotary blade ring and receives the feed material in an axial direction parallel to the axis of rotation. A counter abutment projects in the axial direction into the comminution chamber. The rotary blade ring is moveable in a radial advancing direction against the counter abutment and applies a pressing force relative to the counter abutment to effect comminution of the feed material in a working position of the counter abutment. The counter abutment has an effective surface facing the feed material and the effective surface is supported so as to be moveable such that, upon surpassing a predetermined value of the pressing force, at least the effective surface performs an escape movement relative to the rotary blade ring in an escape direction.

12 Claims, 9 Drawing Sheets

40
40
31
14
35
15
27
10
13
8
20
19
17
18
29
26
33
28
34
30
39
12
5
2
21
7
1
3
6
4
I
I
II
II

DEVICE FOR COMMINUTING FEED MATERIAL

BACKGROUND OF THE INVENTION

1. Field of the Invention

The invention relates to a device for comminuting material, in particular, material in the form of trunk wood and residual wood as well as wood material combined to a packet, comprising a comminution chamber surrounded by a rotary blade ring into which the material is fed in the axial direction, wherein, for the purpose of comminution, the rotary blade ring is movable in the radial direction against an abutment projecting axially into the comminution chamber.

2. Description of the Related Art

Devices of the aforementioned kind for comminution of material are known, for example, from DE 35 05 077. Such devices have a horizontally movable carriage on a stationary frame. On the carriage a comminution apparatus is arranged which is comprised substantially of a rotary blade ring surrounding a comminution chamber. The cutting edges of the comminution tools project with a short projecting length from the inner side of the rotary blade ring into the comminution chamber. For providing an abutment during the comminution process, the device of the aforementioned kind has a stationary abutment which projects axially into the comminution chamber.

For comminuting the feed material, the feed material is fed axially into the comminution chamber and secured within as well as outside of the comminution chamber. By horizontally moving the carriage and thus also the rotating blade ring, the material is compressed between the counter abutment and the rotary blade ring and at the same time comminuted by the cutting edges of the rotary blade ring. By means of the continued advancing movement of the rotary blade ring in the direction toward the abutment, the pressing force required for comminution is maintained. After completion of a working stroke, with which a section of the feed material corresponding to the depth of the comminution chamber has been processed to chips or cuttings, the carriage together with the rotary blade ring moves back into its initial position, and the material is then advanced farther by the length of a further section into the comminution chamber. In this way, a cycled comminution of the feed material by the depth of the comminution chamber, respectively, is achieved.

Such devices have proven very successful in practice. Problems occur only when the material is contaminated by hard foreign bodies. The hard foreign bodies can be, for example, broken-off parts of woodworking tools of previous processing stations or shrapnel dating back to the World Wars I and II that have penetrated into the trunk wood. They are engaged during the course of the comminution of the material by the comminution tools of the rotary blade ring and cause increased wear, and, in more serious cases, even destruction of machine parts.

In order to overcome this problem, it has been suggested to test the material with regard to foreign bodies by means of detectors. According to this method, feed material contaminated by foreign bodies can already be sorted out prior to processing. However, experience has shown that, actually, this is achieved only unsatisfactorily so that a residual risk is still present for the devices of the aforementioned kind.

In order to prevent this residual risk, it is also already known to provide a device of the aforementioned kind with a monitoring and control system. It monitors, on the one hand, the drawing of current at the drive side of the device and, on the other hand, the operating pressure of the cylinder-piston unit which provides the feed action of the rotary blade ring. A sudden increase of the current draw and/or a sudden increase of the operating pressure of the cylinder-piston unit indicates a foreign body within the feed material. In order to protect the comminution device, the cylinder-piston unit which provides the feed action is then switched to a pressureless state for reducing the pressing force between the comminution tool and the foreign body. Parallel to this, braking and stopping of the rotary blade ring can be realized.

Both alternatives, however, have the disadvantage that a reaction in response to the signal indicating the foreign body can be provided only with some temporal delay. This is caused, on the one hand, by the large mass of the rotating blade ring and the resulting great kinetic energy as well as the inertia of the hydraulic advancing or feeding system. Possibly, the rotary blade ring cannot be protected from damage as a result of the temporally delayed counter measures.

SUMMARY OF THE INVENTION

It is an object of the present invention to development the devices of the aforementioned kind such that feed material contaminated with foreign bodies cannot cause any damage during operation of such a device.

In accordance with the present invention, this is achieved in that at least the effective surface of the counter abutment facing the feed material is moveably supported so that, upon surpassing a predetermined value of the pressing force caused by the advancing of the rotary blade ring, at least the effective surface of the counter abutment will yield to or perform an escape movement relative to the rotary blade ring.

The invention takes an entirely new direction for solving the aforementioned object in that it no longer changes the pressing force acting on the comminution blades indirectly via the control of the cylinder-piston unit driving the carriage but reduces directly the pressing force required for an effective comminution. This is realized by providing an escape movement of the counter abutment in the advancing direction of the rotary blade ring.

With this inventive concept, the pressing force onto the comminution tools is reduced directly without any intermediate action so that a very fast response for protecting the device according to the invention is realized. This escape movement of the counter abutment is effected by the pressing force which is present within the comminution chamber so that for this purpose no additional force expenditure is required. Moreover, the parts which are to be moved for damage control have relatively small dimensions with a corresponding minimal weight so that their minimal inertia further improves a quick response.

The escape movement of the counter abutment can be realized in different ways. Preferred is a parallel movement of the surface of the counter abutment facing the rotary blade ring in the advancing direction or feed direction of the rotary blade ring.

As a result of the specific weight and primarily of the entrainment effect of the comminution tools, the foreign bodies will collect preferably in the area of the counter blade, i.e., in the lower area of the comminution chamber. An escape movement of the effective surface of the counter abutment in this area can also be made possible by a pivot movement of the effective surface about an axis extending horizontally in the upper area of the counter abutment.

A preferred embodiment of the invention provides for a substantially two-part configuration of the counter abutment. In this connection, on a stationary part of the counter abutment, which receives the abutment forces occurring during operation, a movable attachment is provided which is facing directly the feed material. This embodiment reduces the number and the weight of the movable parts of the counter abutment to a minimum so that this embodiment ensures very short response times. The movability between the rigid part and the attachment is ensured by guide elements which are aligned in the advancing direction.

In other preferred embodiments the counter abutment is a rigid or stiff structure which is movably supported on the remaining stationary structure of the device outside of the comminution chamber. In this way, larger moving masses are obtained but this configuration has the advantage of an improved accessibility of the moveable support and the drive. A further advantage of this configuration is based on the simple configuration of the part of the counter abutment projecting into the comminution chamber which can be formed with minimal thickness as a result of its unitary configuration. In this connection, for identical rotary blade ring size an enlargement of the comminution chamber results so that it can receive and process more feed material. In this embodiment, the movability of the counter abutment is realized by means of a sliding support on the stationary structure of the device.

Further advantages result from a combination of the aforementioned embodiments in which a counter abutment with attachment is additionally moveably secured by means of its support arm on the stationary structure external to the comminution chamber. The two systems for providing an escape movement can cooperate in this connection such that a first quick escape movement is realized via the attachment on the support arm and a further escape movement is realized by a movement of the support arm.

In a simplified embodiment of the invention, the counter abutment is secured by means of a spring element in its nominal or working position. The spring force corresponds in this connection to a predetermined value of the pressing force for which the presence of foreign bodies does not yet cause appreciable damage. Upon surpassing this pressing force value, the counter abutment moves back with compression of the spring element and prevents greater damage.

An especially preferred embodiment of the invention has a monitoring and control system as well as at least one cylinder-piston unit which secures the counter abutment in its nominal or working position. Upon reaching a predetermined value of the pressing force, which signals the presence of foreign bodies at the comminution tools, the cylinder-piston unit is switched to a pressureless state in order to thus initiate an escape movement of the counter abutment.

This embodiment has the advantage that the starting point for the escape reaction can be controlled very precisely. Since the feed material to be comminuted is present in a compressed state within the comminution chamber, the switching of the cylinder-piston unit into a pressureless state provides a relaxation possibility for the feed material which effects the restoring force for the escape movement of the counter abutment.

According to further embodiments of the invention, this restoring force can be actively enhanced for accelerating the escape movement in that double-acting cylinder-piston units and/or pre-stressed spring elements are used.

DESCRIPTION OF THE PREFERRED EMBODIMENTS

Figure 1:
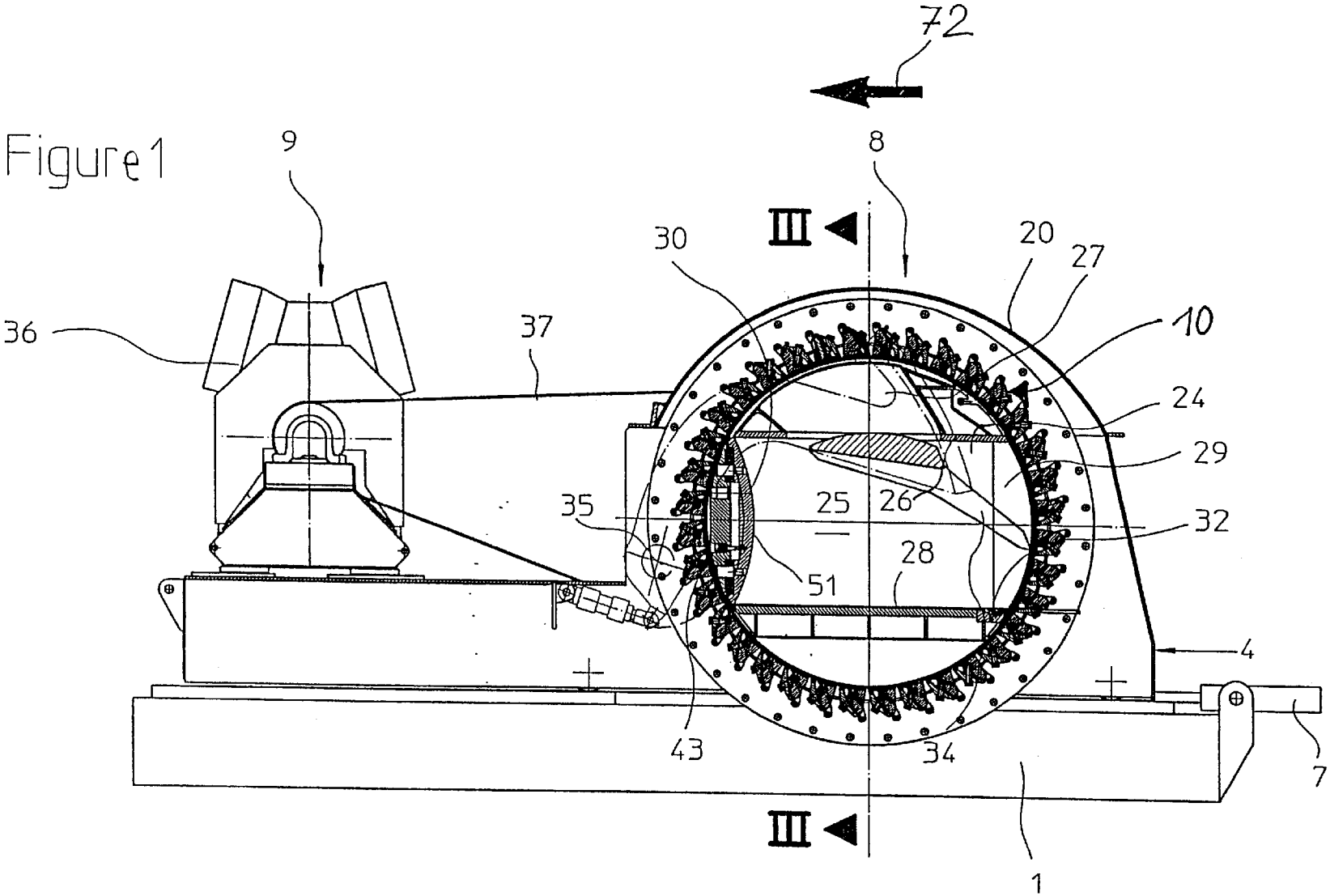
FIG. 1 is a vertical longitudinal section of the device according to the invention along the line I—I illustrated in FIG. 2.
Figure 2:
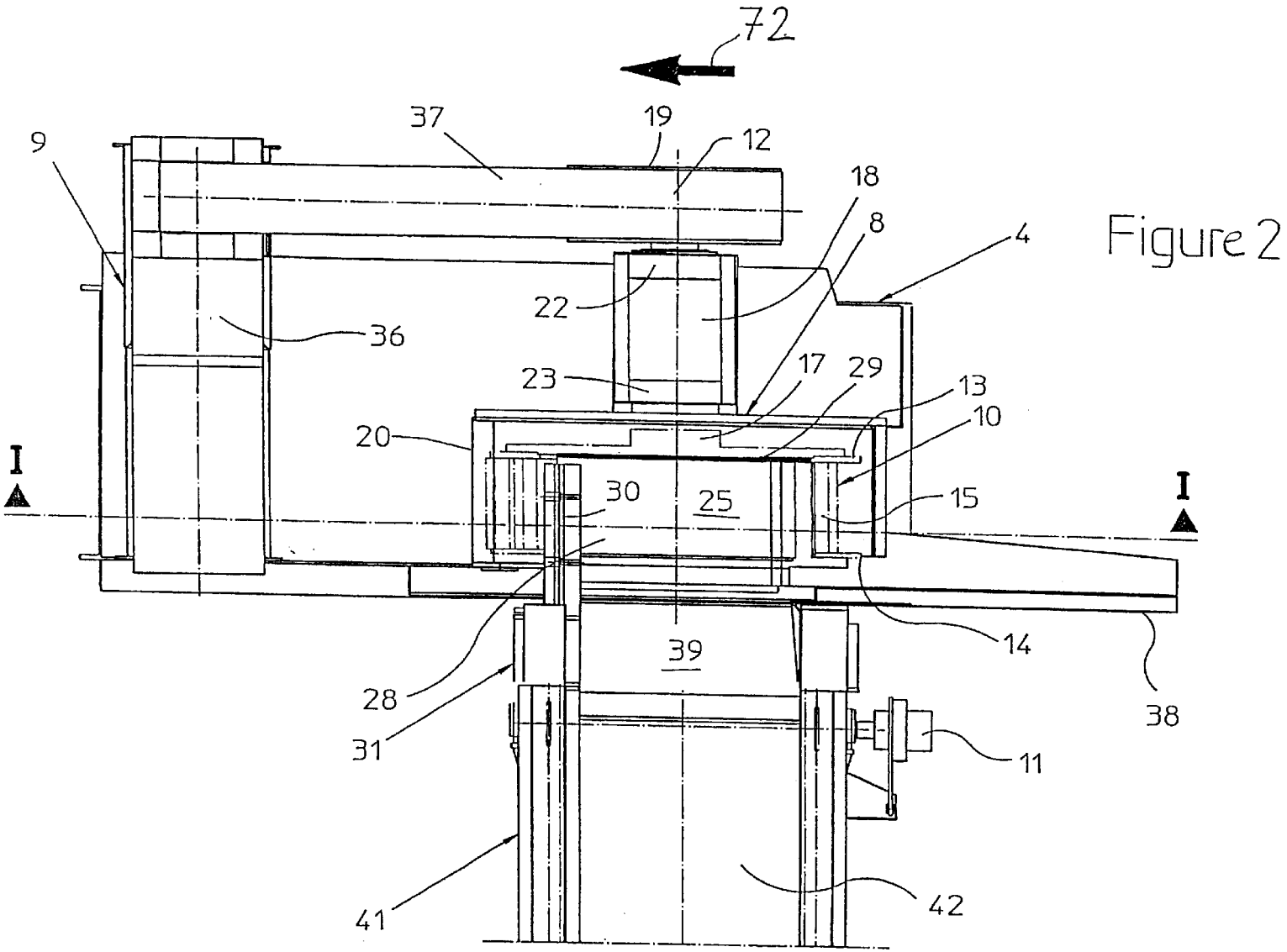
FIG. 2 is a horizontal longitudinal section of the device according to the invention along the line II—II illustrated in FIG. 3.
Figure 3:
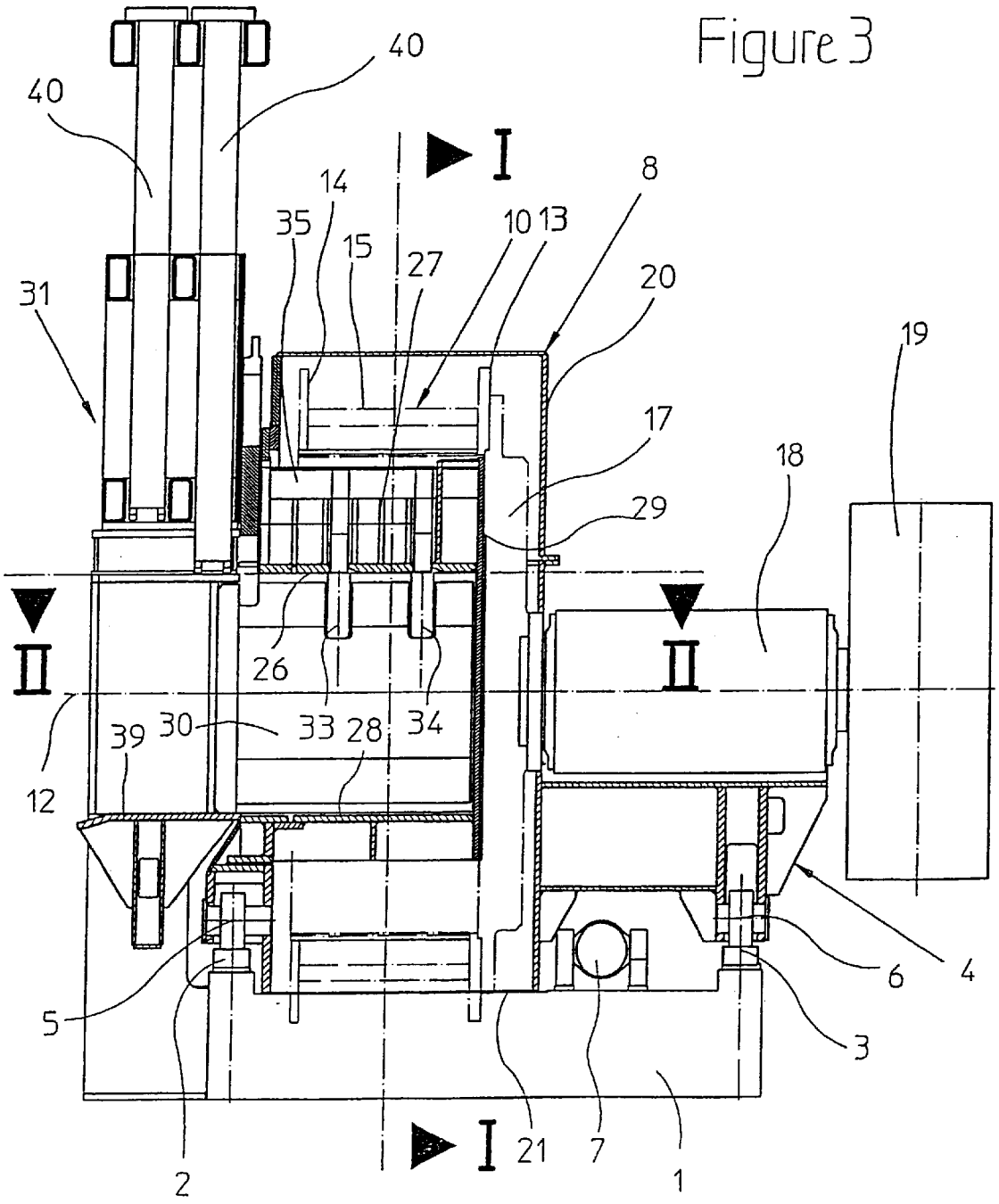
FIG. 3 is a vertical cross-section of the device according to the invention along the line III—III illustrated in FIG. 1.

In FIGS. 1, 2, and 3 a comminution device according to the invention is illustrated in essential section views. They show a frame 1 fixedly anchored to the ground which has two horizontal and parallel rails 2 and 3 at its upper side which are slightly projecting from the surface of the frame 1. The frame 1 serves for receiving a movable carriage 4 which is supported on wheels 5 and 6 and can be moved by means of the advancing cylinder 7 along the rails 2 and 3.

The carriage 4 is comprised substantially of a basic frame forming a platform on which a comminution apparatus 8 and its drive unit 9 are arranged so as to be movable therewith.

The central component of the comminution device 8 is a rotary blade ring 10 which rotates about a horizontal axis 12 extending transversely to the rails 2 and 3. The rotary blade ring 10 is formed by two annular discs 13 and 14 which are coaxial to one another and spaced apart at a distance from one another. They are rigidly connected to one another by means of a plurality of blade carriers 15 which are axially arranged at the circumference. The comminution or chipping blades which are fastened on the blade carriers 15 project with their cutting edge projection into the interior defined by the rotary blade ring 10 and thus define the cutting edge circle during operation.

The annular disc 13 which is positioned deeper within the comminution chamber 16 is coupled with its outer annular surface 2 to a support disc 17 which is also coaxially positioned and, in turn, is connected to a drive shaft 18 whose free end supports a multi-groove pulley 19.

A housing 20 surrounds the rotary blade ring 10 with ample space and makes possible the removal of the comminuted material by means of a lower outlet 21. In the area of the drive shaft 18 the housing 20 has two bearing groups 22 and 23 which receive the drive shaft 18. At the front side of the comminution apparatus 8, a feed opening 24 which corresponds substantially to the size of the rotary blade ring 10 and is positioned opposite thereto is provided via which the feed material is supplied to the comminution tools.

The inner space of the comminution apparatus 8 which is surrounded by the rotary blade ring 10 has a comminution chamber 25 whose upper side is delimited by a horizontally extending cover plate 26 which projects with both ends into close vicinity of the cutting edge circle. The cover plate 26 has a top segment 27. The underside is formed by a massive bottom plate 28 which also extends into close vicinity of the cutting edge circle. At the backside the comminution chamber 25 is delimited by a closure wall 29 which provides a depth stop for the feed material and covers the rotating support disc 17.

Parallel to the axis 12 a counter abutment 30 projects through the feed opening 24 into the interior. This will be explained in more detail in connection with FIGS. 4 and 5. The counter abutment 30 covers on one side of the comminution chamber 25 the portion of the rotary blade ring 10 extending between the cover plate 26 and the bottom plate 28. In contrast to the other parts delimiting the comminution chamber 25 which follow the advancing movement 72 of the carriage 4, the counter abutment 30 is stationarily attached to a portal structure (support structure) 31 positioned opposite the feed opening 24 (FIGS. 2 and 3). The portion of the rotary blade ring 10 positioned horizontally opposite the counter abutment 30 forms the comminution zone where the feed material is brought into engagement with the comminution or chipping tools. In the area of the comminution zone the bottom plate 28 is provided with a wear-resistant counter blade 32.

For securing the feed material during the comminution process, two pressing blades 33 and 34 project from the top segment 27 in two radial planes. They are arranged in a comb-like arrangement on a common blade support 35 and can be pivoted about the bearing axle 35 into the comminution chamber 25. For this purpose, the cover plate 26 has corresponding cutouts.

Laterally adjacent to the comminution or chipping chamber 25 in the area of the comminution zone a planar protective shield 38 is arranged at the front side of the housing 20. The front side of the protective shield 38 is positioned in the plane of the separating cut and thus moves during the course of the working stroke into a position in front of the end faces of the feed material that have just been cut or chipped. Accordingly, the movement path of the comminution apparatus 8 is protected against pieces of wood that could penetrate into the movement path and thereby impair the operation of the comminution device.

The rotary blade ring 10 is rotated by a drive unit 9 which is mounted at a short lateral spacing adjacent to the comminution apparatus 8 on the carriage 4. The drive unit 9 is comprised substantially of an electric motor 36 which is connected by a drive belt 37 to the multi-groove pulley 19.

Moreover, FIGS. 2 to 3 show directly in front of the comminution chamber 25 a stationary portal structure 31 whose support surface 39 projects slightly relative to the bottom plate 28 of the comminution chamber 25 by a minimal amount. Above the pressing surface 39 and at a spacing matching the height of the comminution chamber 25, pressing elements 40 in the form of weights are arranged which can be lowered and which secure the feed material directly in front of the comminution chamber 25 during the comminution (chipping) process.

A trough-shaped feed gutter 41 adjoins directly the rear side of the portal structure 31 and has a bottom formed by a conveyor belt 42 which provides transportation of the feed material to the comminution apparatus 8. The drive for the conveyor belt 42 is indicated at 11.

Figure 4:
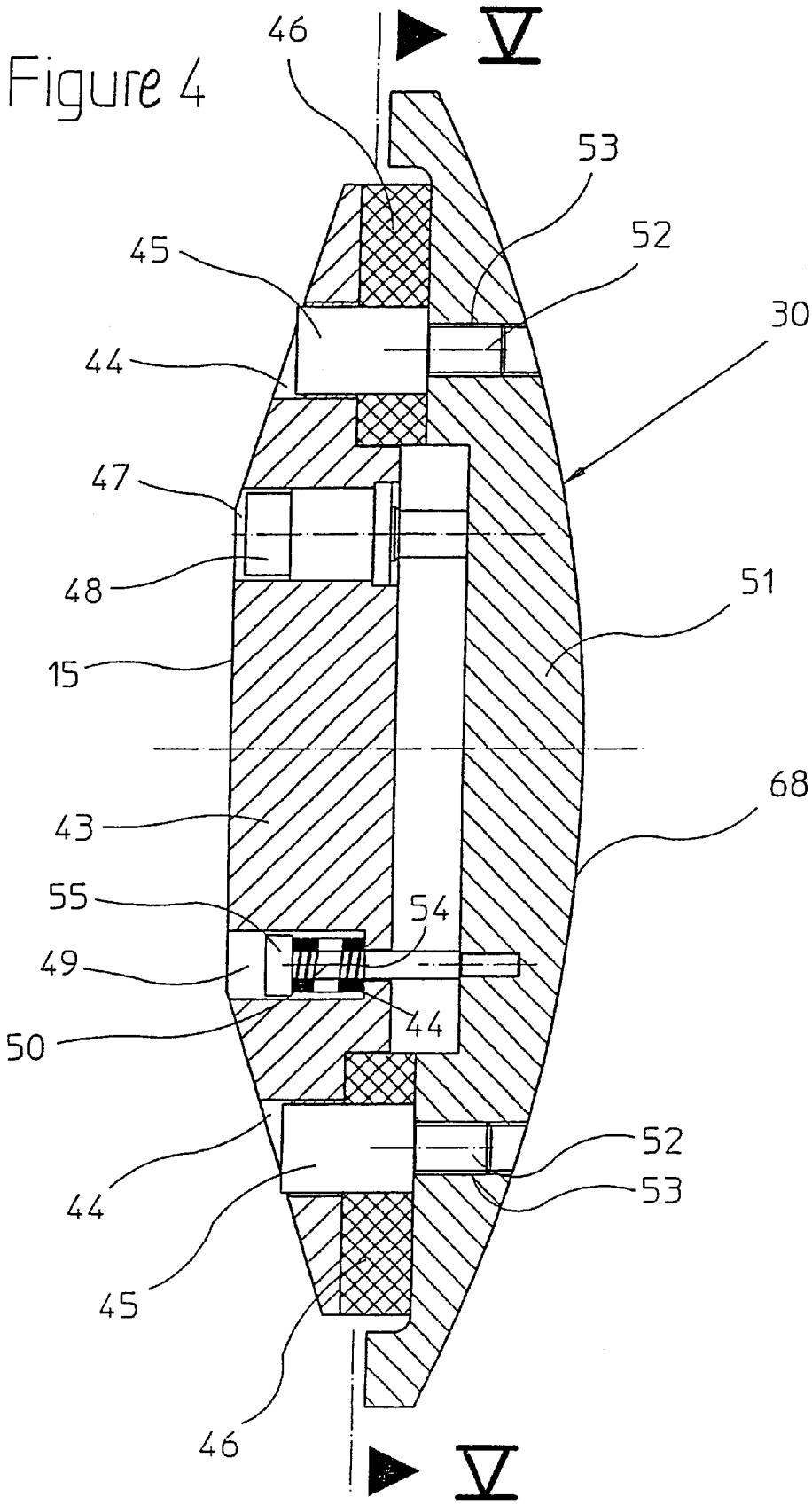
FIG. 4 is a cross-section on a large scale of the counter abutment in the area of the comminution chamber.
Figure 5:
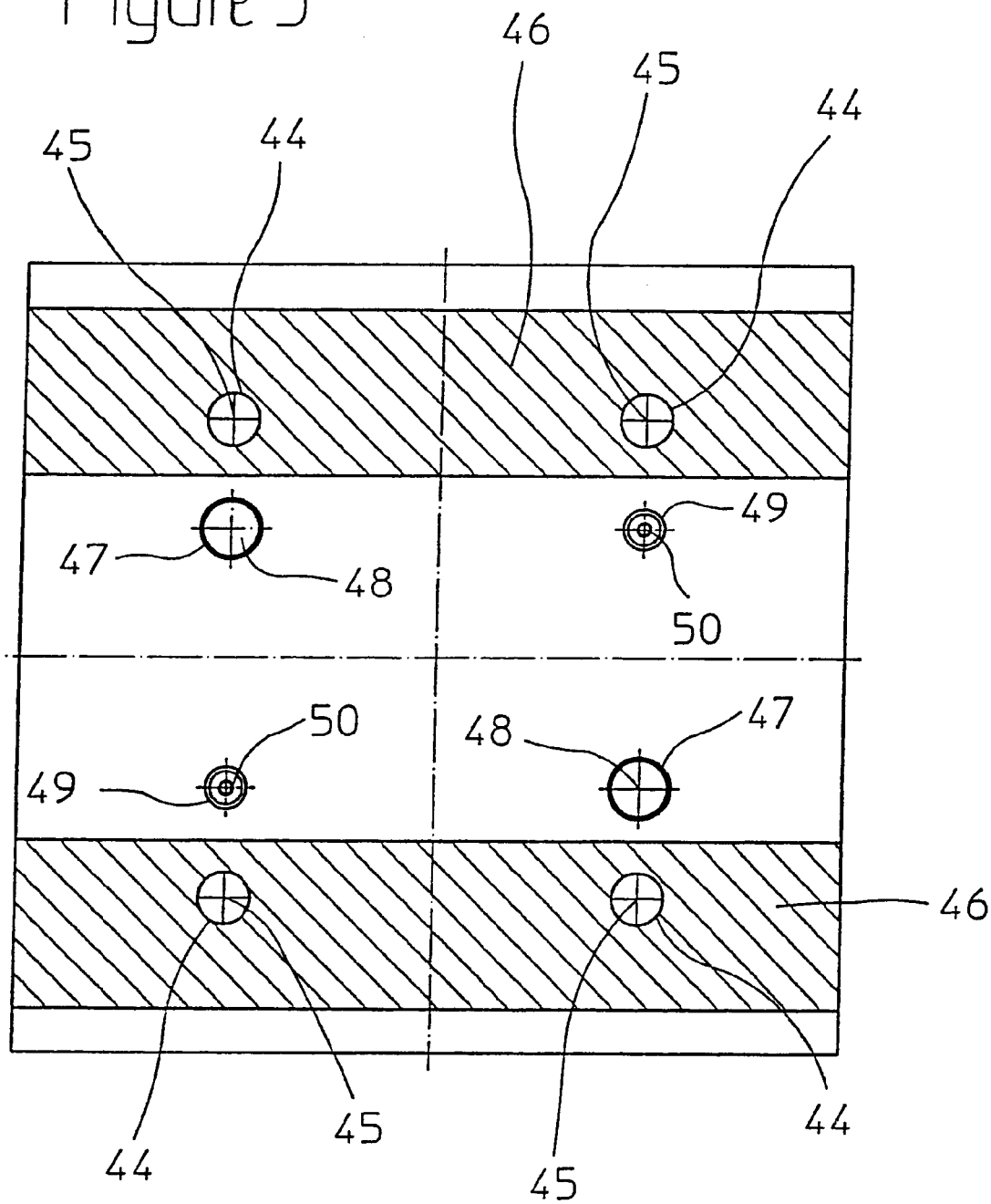
FIG. 5 is a longitudinal section of the counter abutment illustrated in FIG. 4 along the line V—V illustrated therein.
Figure 6:
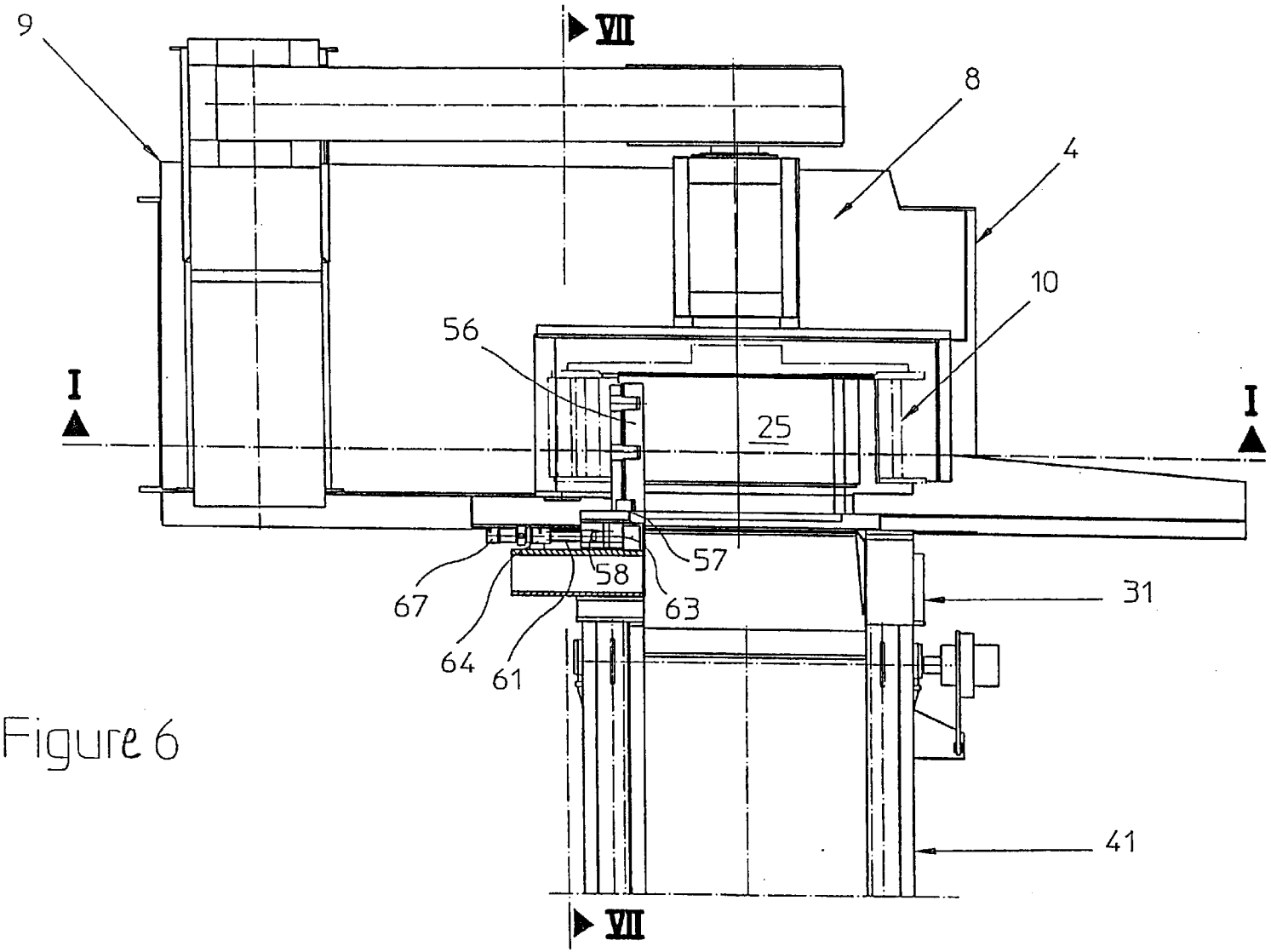
FIG. 6 is a horizontal longitudinal section of a further embodiment of the device according to the invention along the line VI—VI illustrated in FIG. 7.
Figure 7:
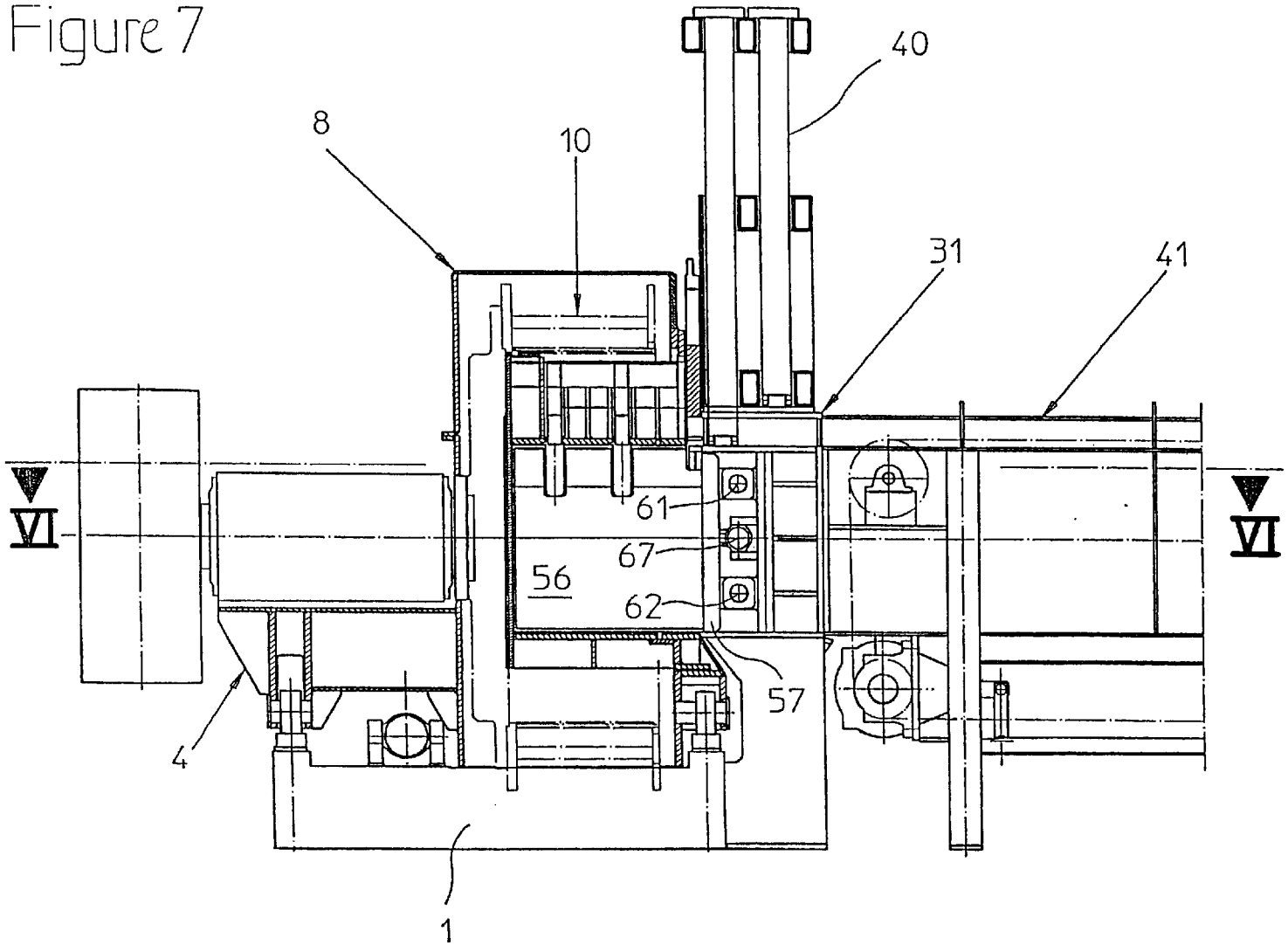
FIG. 7 is a vertical longitudinal section of the device illustrated in FIG. 6 along the line VII—VII shown therein.
Figure 9:
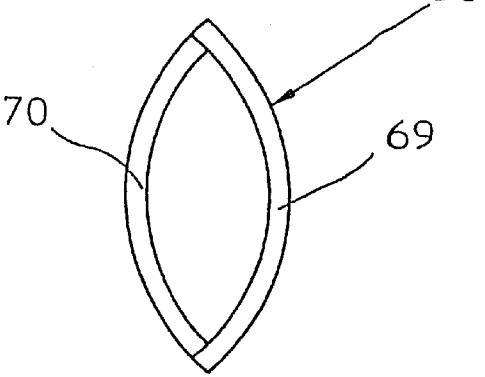
FIG. 9 is a cross-section of the counter abutment illustrated in FIG. 8 along the line IX—IX shown therein.
Figure 8:
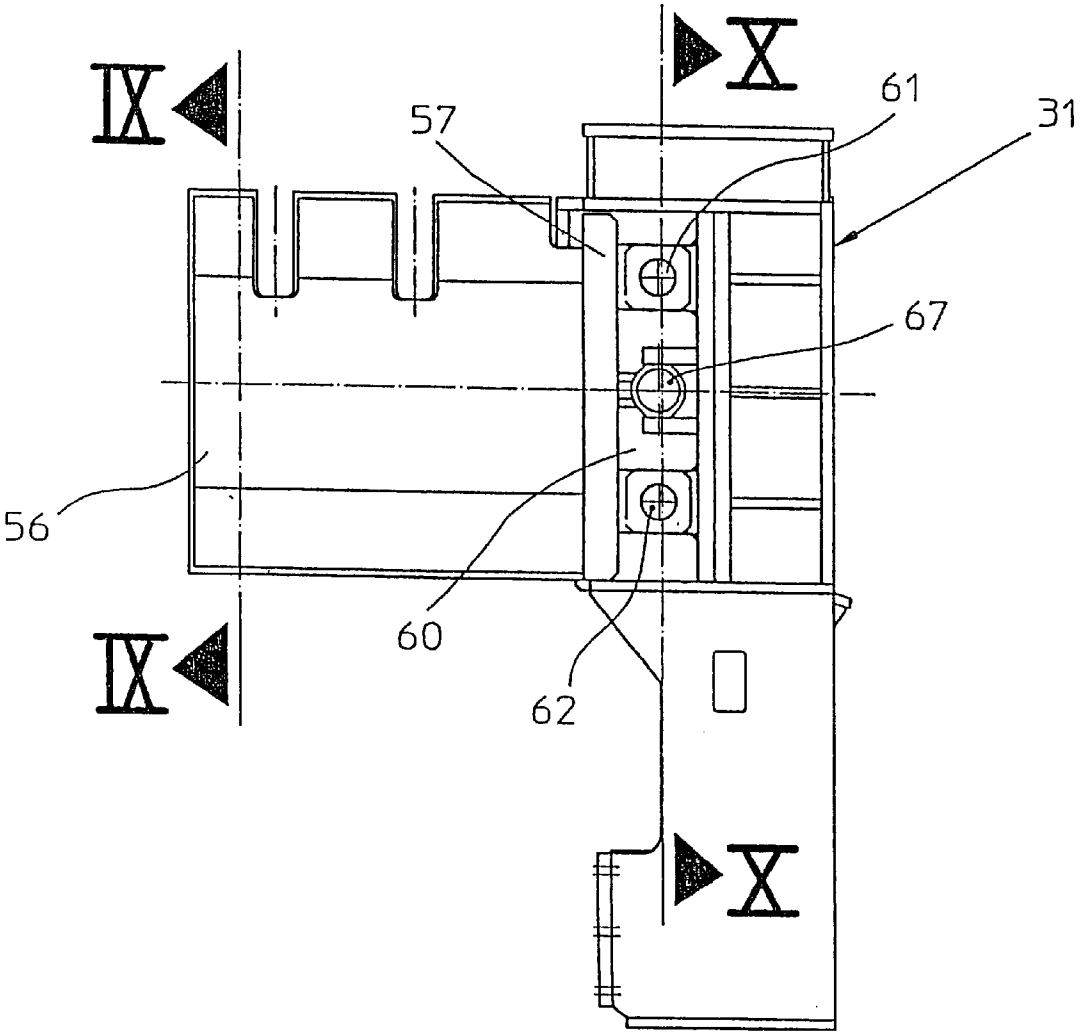
FIG. 8 is detail view of the device illustrated in FIGS. 6 and 7.

The precise configuration of the first embodiment of the counter abutment 30 can be seen in FIGS. 4 and 5. The counter abutment 30 has first a stationary support arm 43 projecting axially into the comminution chamber 25 which is connected with its end projecting out of the comminution chamber 25 by a head flange rigidly to the portal structure (support structure) 31. During the radial advancing movement 72 of the carriage 4 and thus of the comminution apparatus 8, the support arm 43 thus provides a stationary reference point within the comminution chamber 25.

The outer side 15 of the support arm 43 is matched in the form of a polygon to the radius of the cutting edge circle and has at the upper and lower edge areas two bores 44, respectively, spaced relative to one another and arranged in the direction of the advancing movement. A bolt 45 is slidably guided in the bores 44, respectively. At the front side of the support arm 43 the upper and lower edge areas are provided with a recess in which foamed material strips 46 are provided as a protection of the sliding seals between the bores 44 and the bolts 45.

In additional bores 47, which are arranged diagonally opposite from one another, hydraulically operated cylinder-piston units 48 are arranged whose movable pistons project from the front side of the support arm 43. In an alternating arrangement thereto bores 49 are provided in which the spring elements 50 are inserted.

In addition, the counter abutment 30 has an attachment 51 which is positioned opposite the inner side of the support arm 43 at a spacing of approximately 5 cm. The attachment 51 has a convexly curved surface 68 which is facing the comminution chamber 25. The oppositely positioned rear side of the attachment 51 follows the contour of the inner side of the support arm 43. In an axial direction the attachment 51 projects approximately from the closure wall 29 to the front side of the machine housing 20. The attachment 51 is secured by the bolts 45 in the nominal position which for this purpose at its end face is provided with a pin 52 which is anchored in a corresponding bore 53 of the attachment 51. In a corresponding way, the spring elements 50 are connected with the attachment 51.

For providing and maintaining a predetermined spacing between the support arm 43 and the attachment 51 during regular operation of the comminution or chipping device according to the invention, the pistons of the cylinder-piston units 48 are extended and accordingly press on the inner side of the attachment 51 and move it along the guided bolt 45 away from the support arm 43. In this connection, the spring element 50 is pre-stressed in that a pressure spring 54 between the base of the bore 44 and the widened bolt head 55 is compressed.

The second embodiment of the invention is illustrated in more detail in FIGS. 6 to 11. With the exception of the counter abutment and its connection to the portal structure 31, the device illustrated therein is substantially identical to the previous embodiment so that the above description applies accordingly.

The second embodiment differs from the previously described embodiment substantially in that the counter abutment 56 is of a unitary (one-part) configuration wherein it has both sides provided with convexly curved surfaces 69, 70 (FIG. 9) positioned in a radial cross-sectional plane. The end of the counter abutment 56 projecting out of the comminution chamber 25 is fastened with its end face on the inner side of a jaw 57. The outer side of the jaw 57 has a horizontal upper guide bushing 58 which is aligned in the advancing direction 72 and a guide bushing 59 arranged underneath and parallel thereto. The bushings 58, 59 represent the movable part of a sliding guide. A vertical reinforcement element 60 connects the two guide bushings 58 and 59 and is welded, in turn, with its longitudinal side to the outer side of the jaw 57.

The stationary part of the sliding guide is fastened on the portal structure 31 and is comprised substantially of guide elements in the form of horizontal sliding rods 61, 62 which are secured at their ends in the bearings 63 and 64 as well as 65 and 66 and are thus rigidly connected with the portal structure 31. The arrangement of the guide bushings 58, 59 on the sliding rods 61, 62 provides for the counter abutment 56 to be movable between the bearings 63, 65 and 64, 66 in the horizontal direction. The advancing force required for this purpose is provided by a hydraulically operated cylinder-piston unit 67 which engages with its movable piston 71 the reinforcement element 60 parallel between the sliding rods 61, 62 and is supported with its stationary cylinder on the portal structure 31.

Figure 11:
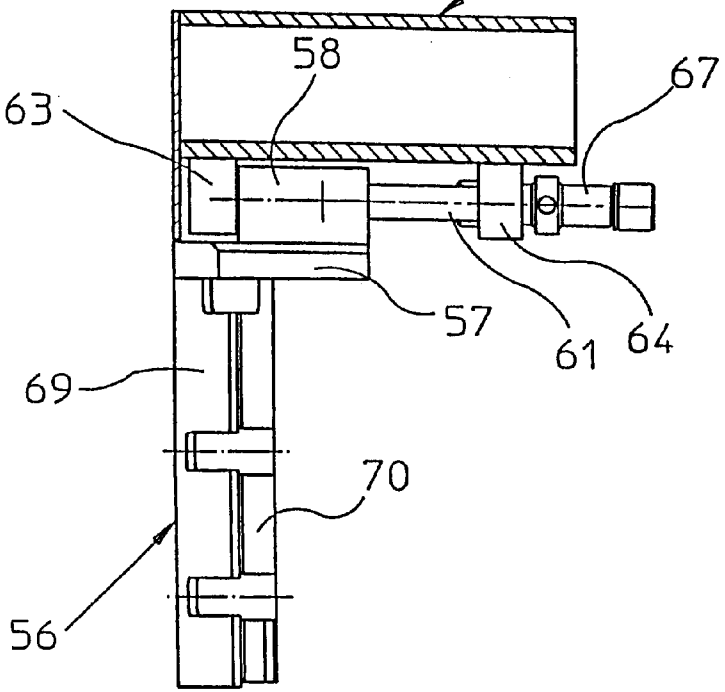
FIG. 11 is a plan view onto the device illustrated in FIGS. 8 through 10.
Figure 10:
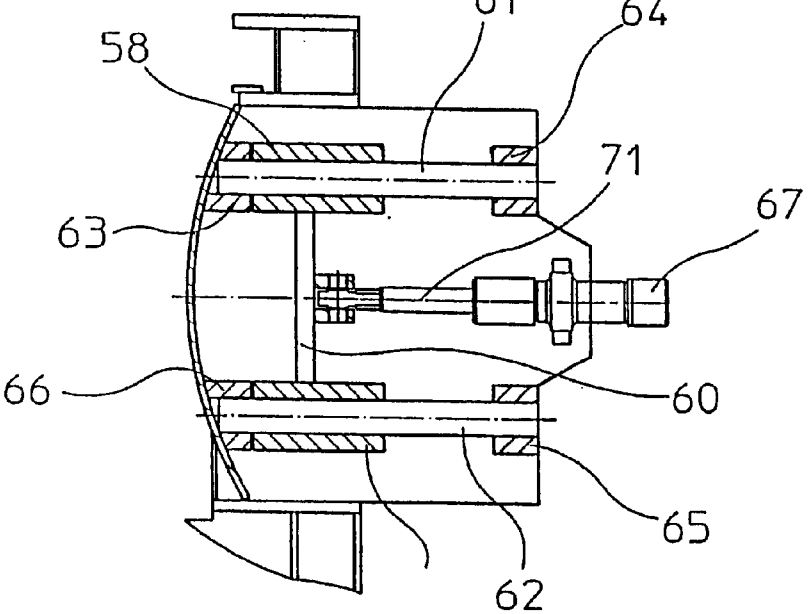
FIG. 10 is a detail of the device illustrated in FIG. 8 along the line X—X shown therein.

The function of the device according to the invention is as follows:

During the regular comminution operation the effective surface 68, 69 on the counter abutment 30 or the entire counter abutment 56 is positioned in a forward operating position moved by a predetermined amount into the comminution chamber 25. This state is illustrated in FIG. 4 and FIG. 11.

A monitoring and control unit examines continuously the comminution or chipping operation in regard to whether irregularities indicate the presence of foreign bodies in the feed material. For this purpose, the monitoring and control unit can be furnished as desired individually or in combination with sensors which detect the current draw of the drive unit 9, the vibrations and/or noise development at the rotary blade ring 10 or the operating pressure at the advancing cylinder 7 and compare these values with predetermined nominal values. When unusual deviations of the measured values relative to the nominal values indicate the presence of foreign bodies, for example, an excessive increase of the current draw of the electric motor 36 or an increased operating pressure of the advancing cylinder 7, the monitoring and control unit initiates immediately countermeasures which effect a receding or escape movement of the effective surface 68, 69 of the counter abutment 30, 56.

In the case of the first embodiment of the invention such measures are the immediate stopping of the advancing movement of the rotary blade ring 10 and/or switching of the cylinder-piston unit 48 to a pressureless state. As a result of the pressing force which is applied onto the effective surface 68 by the compressed feed material, the attachment 51 escapes suddenly in the direction of the support arm 43 so that the foamed material strips 46 are compressed. This escape movement is assisted and continued by the spring elements 50 which are pre-stressed in the working position and which now relax. As a result of the escape movement of the attachment 51, the feed material with foreign bodies contained therein is no longer pressed against the comminution tools and the risk of damage is thus eliminated.

In the case of the second embodiment of the invention, the advancing movement of the rotary blade ring 10 is stopped also. At the same time, in the case of the double-acting cylinder piston unit 67 a thrust reversal is initiated which effects an active return of the entire counter abutment 56 along the sliding rods 61 and 62. The resulting volume increase of the comminution chamber 25 allows for a relaxation of the compressed feed material so that the pressing force of the feed material acting on the rotary blade ring 10 decreases and, in this way, the comminution device is protected against damage.

While specific embodiments of the invention have been shown and described in detail to illustrate the inventive principles, it will be understood that the invention may be embodied otherwise without departing from such principles.

What is claimed is:

1. A device for comminuting feed material, the device comprising:

a rotary blade ring configured to rotate about an axis of rotation;

a comminution chamber enclosed by the rotary blade ring and configured to receive the feed material in an axial direction parallel to the axis of rotation;

a counter abutment projecting in the axial direction into the comminution chamber;

wherein the rotary blade ring is configured to be moveable in a radial advancing direction against the counter abutment and to apply a pressing force relative to the counter abutment to effect comminution of the feed material in a working position of the counter abutment;

wherein the counter abutment has an effective surface facing the feed material and wherein the effective surface is supported so as to be moveable such that, upon surpassing a predetermined value of the pressing force, at least the effective surface performs an escape movement relative to the rotary blade ring in an escape direction.

2. The device according to claim 1, wherein the counter abutment comprises a first part and a second part, wherein the first part is a stationary part and the second part is slidably connected to the first part in the area of the comminution chamber, wherein the second part forms the effective surface.

3. The device according to claim 1, comprising a stationary support structure arranged external to the comminution chamber, wherein the counter abutment is slidably supported on the stationary support structure.

4. The device according to claim 1, wherein the counter abutment has at least one guide element and wherein the effective surface is configured to be slidable along the at least one guide element.

5. The device according to claim 4, wherein the at least one guide element is comprised of a bushing and a guide rod slidably arranged in the bushing.

6. The device according to claim 1, wherein the counter abutment comprises a spring element, wherein the effective surface is secured by the spring element in a nominal position, and wherein the spring force of the spring element matches the predetermined value of the pressing force.

7. The device according to claim 1, wherein the counter abutment comprises a spring element and is secured by the spring element in the working position, wherein the spring force of the spring element matches the predetermined value of the pressing force.

8. The device according to claim 1, comprising a monitoring and control unit and a piston-cylinder-unit, wherein the piston-cylinder unit secures the effective surface in the working position, and wherein the monitoring and control unit is coupled to the piston-cylinder unit such that, upon reaching the predetermined value of the pressing force, the piston-cylinder unit is switched to a pressureless state.

9. The device according to claim 1, comprising a monitoring and control unit and a piston-cylinder-unit, wherein the piston-cylinder unit secures the counter abutment in the working position, and wherein the monitoring and control unit is coupled to the piston-cylinder unit such that, upon reaching the predetermined value of the pressing force, the piston-cylinder unit is switched to a pressureless state.

10. The device according to claim 1, comprising a monitoring and control unit and a double-acting piston-cylinder-unit with a moveable part, wherein the double-acting piston-cylinder unit secures the effective surface in the working position, and wherein the monitoring and control unit is coupled to the double-acting piston-cylinder unit such that, upon reaching the predetermined value of the pressing force, the moveable part of the double-acting piston-cylinder unit actively moves in the radial advancing direction.

11. The device according to claim 1, comprising a monitoring and control unit and a double-acting piston cylinder-unit with a moveable part, wherein the double-acting piston-cylinder unit secures the counter abutment in the working position, and wherein the monitoring and control unit is coupled to the double-acting piston-cylinder unit such that, upon reaching the predetermined value of the pressing force, the moveable part of the double-acting piston-cylinder unit actively moves in the radial advancing direction.

12. The device according to claim 1, comprising spring elements that are pre-stressed in the working position of the counter abutment and act in the escape direction.

* * * * *